United States Patent [19]

Brobeck

[11] 4,229,852

[45] Oct. 28, 1980

[54] PORTABLE PIPE CLEANING APPARATUS

[76] Inventor: Glenn H. Brobeck, 193 Geneva Dr., Aliquippa, Pa. 15001

[21] Appl. No.: 963,165

[22] Filed: Nov. 22, 1978

[51] Int. Cl.[3] ..... B08B 9/02

[52] U.S. Cl. ..... 15/3.5; 51/436; 134/102

[58] Field of Search ..... 15/3.5, 3.51; 51/411, 51/426, 436–438; 134/94, 102, 171, 166 C, 167 C, 168 C

[56] References Cited

U.S. PATENT DOCUMENTS

| | | | |
|---|---|---|---|
| 1,816,583 | 7/1931 | Hull | 51/436 |
| 1,939,836 | 12/1933 | Tolfree | 134/102 X |
| 2,818,076 | 12/1957 | Erling | 134/102 |
| 3,021,646 | 2/1962 | Williams | 51/436 |
| 3,139,704 | 7/1964 | McCune | 15/3.5 X |
| 3,266,193 | 8/1966 | McCune | 51/436 |

*Primary Examiner*—Edward L. Roberts
*Attorney, Agent, or Firm*—Webb, Burden, Robinson & Webb

[57] ABSTRACT

A portable pipe cleaning apparatus is provided which comprises a tank capable of withstanding pressures of at least about 200 psi. A plurality of outlet valve means are in communication with the tank, with the valves adapted to be opened independently of each other. The valves function to allow a variable discharge from the tank. Means are provided for directing the discharge from the tank regulated by, and in communication with the outlet valve means. Means are also provided for charging an aggregate to dispense with the discharge. The apparatus is particularly adapted to be used with air and water under pressure by the alternate opening and closing of the valves providing a variable discharge of highly aerated water at a variable velocity.

7 Claims, 2 Drawing Figures

PORTABLE PIPE CLEANING APPARATUS

BACKGROUND OF THE INVENTION

Field of the Invention

This invention relates to pipe cleaning apparatus and more particularly to pipe cleaning apparatus using pressurized water.

In many industrial processes river or stream water is used as a cooling media in condensers, furnace doors, furnace jackets and generally for purposes of heat transfer. Further, this river or stream water may be used in industrial sewer lines.

Because river water contains any number of chemical and biological impurities, encrustment builds up within the inner periphery of these water conduits and causes flow rate reduction and sometimes stoppage. The encrustment is composed of scale from corrosion of the pipes, algae build-up and in industrial sewage systems, refuse. To provide efficient cooling or discharge, the encrustment must from time to time be cleaned by either mechanical means (such as reaming), chemical means or by use of hydrostatic pressure. Of these three optional methods, hydrostatic pressure has been the most economic, yet somewhat lacking in efficiency and restricted to specific applications. One such method of hydrostatic pipe cleaning is disclosed in U.S. Pat. No. 3,600,225 which uses a self-propelled nozzle which issues high pressure water therefrom. Briefly, the hose leads from a water tank having a high pressure pump associated therewith which delivers water at about 1,000 psi. The nozzle of the hose is arranged to emanate water backwardly from the hose, thus impelling the nozzle and hose into the pipe. The water impinges upon the encrustation on the pipe, thus flushing the impurities backwardly and into a separator which removes the solid impurities and recycles the water.

Another similar system is sold by Meyers-Sherman Company under the trademark "VACTOR JET-RODDER" and is shown in a brochure which was published in 1973. Although this type of system has achieved some acceptance in the cleaning of sewers, access of the hose to the interior of the waterline must be provided in using this system. A further disadvantage of the system wherein the hose is placed in the waterlines for cleaning, is that high pressure pumps must be provided to enact a variable water force with a hammer-like action. These pumps are expensive and must be maintained for the system to operate effectively.

In accordance with the present invention, an apparatus for cleaning pipes is provided which eliminates high pressure pumps yet provides the hammer-like action required for efficient cleaning. A further advantage of the present invention is that the apparatus is adapted to be connected directly and externally of the water pipe or system, thus eliminating the necessity for placing apparatus within the water system itself, thereby allowing utilization within water systems having controverted interiors.

BRIEF DESCRIPTION OF THE INVENTION

A portable pipe cleaning apparatus is provided which comprises a tank capable of withstanding pressures of at least about 200 psi. A plurality of outlet valve means are in communication with the tank and a single discharge outlet, with the valves adapted to be opened independently of each other. The valves function to allow a variable discharge from the tank. Means are provided for directing the discharge from the tank, regulated by, and in communication with the outlet valve means. Means are also provided for charging an aggregate to dispense with the discharge. The apparatus is particularly adapted to be used with air and water under pressure by the alternate opening and closing of the valves providing a variable discharge of highly aerated water at a variable velocity.

DETAILED DESCRIPTION OF THE DRAWINGS

Figure 1:
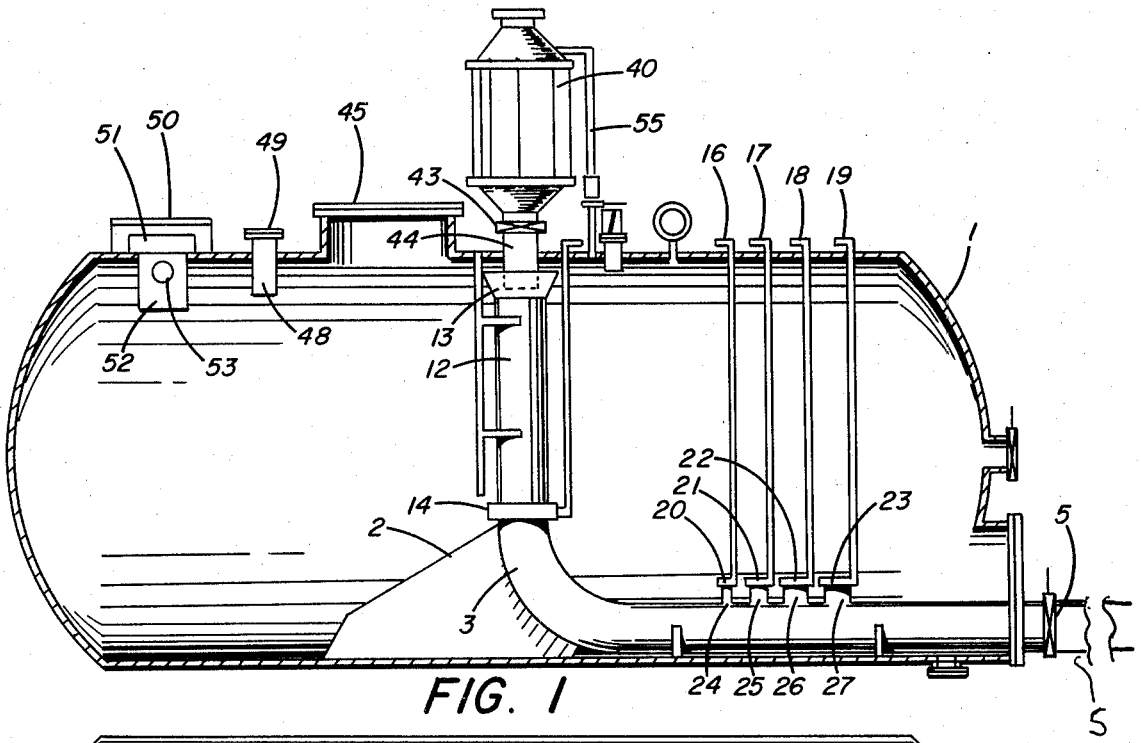
FIG. 1 is a side sectional view of the apparatus of the invention.
Figure 2:
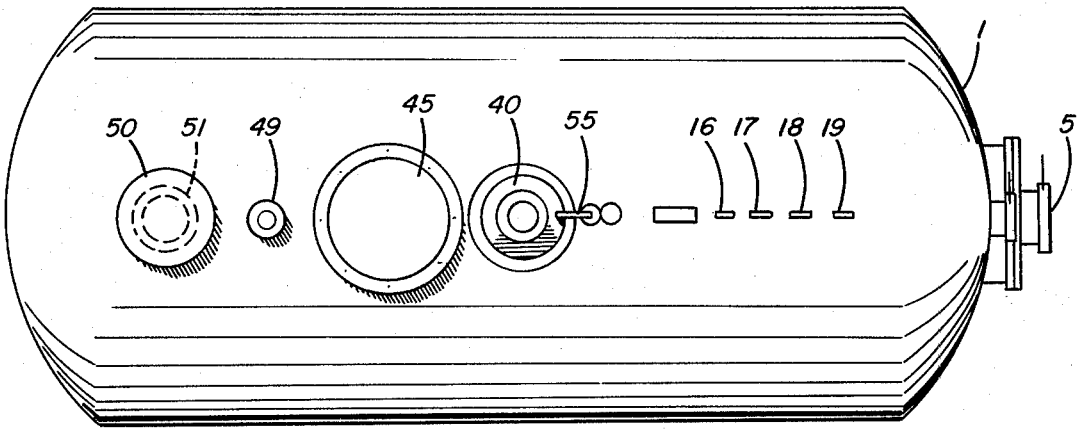
FIG. 2 is a top view of the apparatus of FIG. 1.
Figure 3:
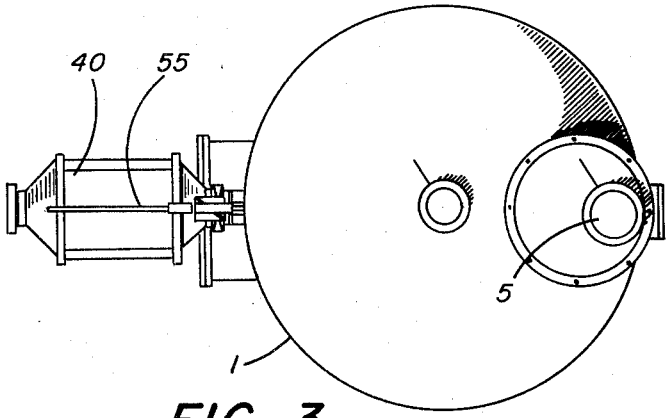
FIG. 3 is a front view of the apparatus shown in FIGS. 1 and 2.

Referring now to the drawings in which like reference numerals refer to like parts, a tank 1 is shown which typically has a capacity of about 4,000 gallons and is capable of withstanding at least 100, and preferably, 200 pounds per square inch pressure. An inlet 48, having a gate valve 49, is mounted in communication with tank 1 to charge water therein. A charging opening, having a housing 50 there around, is in communication with the tank for the introduction of air to pressurize the tank, preferably up to about 150 psi. An air filter 51 is mounted within housing 50 which is in communication with an automatic water shut-off housing 52 with a stem mounted within the housing 52 attached to ball 53. Thus, the air charging inlet to the tank 1 is a one way valve for charging air to the tank.

A manhole 45 is provided for access into the tank for servicing and the like and is necessary in the initial construction of the tank itself as will be hereinafter described.

A conduit on pipe 3 is mounted within the tank and extends to a discharge outlet 5 exterior of the tank 1. A thrust block 2 is welded to the interior of the tank and supports pipe 3. Pipe 3 is supplied with a plurality of valves 20, 21, 22 and 23 which are opened and closed exteriorly of the tank 1 by protruding handles 16, 17, 18 and 19. Upon actuation of the valves 20 through 23, water and air flow from the interior of the tank into pipe 3 and out discharge opening outlet 5.

In operation one of the valves 20 through 23 is open with the remaining valves in the closed position. Upon alternate operation of the valves, a pulsating effect is imparted to the water and air emanating from discharge outlet 5 of pipe 3. Also a variable rate of discharge or pulsating effect is provided by the varying diameters of the connecting nipples 24, 25, 26 and 27 associated with the respective valves 20 through 23 allowing more or less water and air to be discharged from outlet discharge 5. The interior end of pipe 3 extends upwardly and is in communication with a conduit 12. The conduit 12 is in communication with the funnel 13 which is fed by a conduit 44 charged by valve 43. An aggregate hold tank 40 discharges aggregate through valve 43 into conduit 12 into pipe 3 and out discharge outlet 5.

In operation water is charged through inlet 48 opened by valve 49 into tank 1, until tank 1 is about half full. Air is then charged into the tank through the valve and opening arrangements of 50 through 53 until a pressure of about 100–200 psi, and preferably 100 psi, is reached. The discharge outlet 5 is connected to the particular waterline or system to be cleaned by connecting system S.

Valves 22 and 23 are opened for a short period of time, i.e. 5 to 10 seconds, to fill the discharge pipe 3 and connecting system S with water to insure that a head of water precedes the air into the water system to be cleaned. The air valve 14 is opened and the air from the tank flushes the water system of the readily removed materials such as mud and silt to an opening in the other end of the water system. The valve 14 is closed and the valves 22 and 23 are opened to charge more high velocity aerated water providing agitation for removal of more tenacious impurities. The alternate opening and closing of valves 14 and 22 and 23 provide the flushing action.

After all mud, silt, etc. is removed, the aggregate, (preferably sand), is charged to the system by opening valve 43 and the water system is sand blasted to remove encrustation. The aggregate hold tank 40 is pressurized at the same level as tank 1 through connecting line 55. Alternately, water, air and sand may be used together by opening the appropriate valves.

The manipulation of valves 20 through 23 provide the proper amount of air and water mixture along with variable water velocity to agitate within the water system.

In addition to the water, air and sand charging apparatus described, a vacuum system can be provided which can be used to remove water, silt and other loosened deposits from the water system.

I claim:

1. An apparatus for cleaning pipes comprising:

(a) a tank capable of withstanding at least about 100 psi; and (b) a plurality of outlet valve means in communication with said tank and with a single discharge outlet means, said valves adapted to be opened independently of each other, said valves functioning to allow a variable discharge of air and water through said valves and outlet means from said tank.

2. The apparatus of claim 1 including means for charging an aggregate to dispense with said discharge.

3. An apparatus for cleaning pipes comprising:

(a) a tank capable of withstanding pressure of at least about 200 psi;

(b) an enclosed conduit within said tank, said conduit extending to the exterior of said tank, said conduit being positioned along the bottom of said tank and extending toward the top of said tank and having a terminus within the tank;

(c) a plurality of valves positioned along the bottom of the conduit communicating the interior of the tank with the interior of the conduit; and (d) a valve positioned toward the top of said conduit communicating the interior of said conduit with the interior of said tank.

4. The apparatus of claim 3 including means for charging an aggregate to said conduit.

5. The apparatus of claim 3 including means associated with said conduit at the end thereof extending to the exterior of said tank for directing the discharge from said tank.

6. The apparatus of claim 3 including means positioned on the exterior of said tank for manipulating said plurality of valves.

7. The apparatus of claim 6 wherein said manipulation means comprise handles each associated with one of said plurality of valves.

* * * * *